US009027699B2

(12) United States Patent
Mitani et al.

(10) Patent No.: US 9,027,699 B2
(45) Date of Patent: May 12, 2015

(54) SPEAKER DIAPHRAGM, SPEAKER, AND PRODUCTION METHOD OF SPEAKER DIAPHRAGM

(75) Inventors: Tetsuo Mitani, Chiyoda-ku (JP); Osamu Murakami, Chiyoda-ku (JP); Masashi Hara, Chiyoda-ku (JP); Akihiro Fujita, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 861 days.

(21) Appl. No.: 13/147,511

(22) PCT Filed: Feb. 19, 2010

(86) PCT No.: PCT/JP2010/052500
§ 371 (c)(1),
(2), (4) Date: Aug. 2, 2011

(87) PCT Pub. No.: WO2010/095704
PCT Pub. Date: Aug. 26, 2010

(65) Prior Publication Data

US 2011/0284317 A1 Nov. 24, 2011

(30) Foreign Application Priority Data

Feb. 23, 2009 (JP) ..... 2009-039601

(51) Int. Cl.
*G10K 13/00* (2006.01)
*H04R 7/12* (2006.01)
*H04R 31/00* (2006.01)

(52) U.S. Cl.
CPC ..... *H04R 7/127* (2013.01); *H04R 31/003* (2013.01); *H04R 2231/001* (2013.01); *H04R 2307/025* (2013.01); *H04R 2307/029* (2013.01)

(58) Field of Classification Search
USPC ..... 181/167, 169; 264/328.18
See application file for complete search history.

(56) References Cited

U.S. PATENT DOCUMENTS

| | | | | |
|---|---|---|---|---|
| 2003/0223613 | A1 | 12/2003 | Hachiya | |
| 2009/0045005 | A1 | 2/2009 | Byon et al. | |
| 2010/0081768 | A1 * | 4/2010 | Kizu et al. | 525/211 |

FOREIGN PATENT DOCUMENTS

| | | | |
|---|---|---|---|
| CN | 101288336 | A | 10/2008 |
| JP | 62 202699 | | 9/1987 |
| JP | 1 121357 | | 5/1989 |
| JP | 2 47999 | | 2/1990 |
| JP | 2 276399 | | 11/1990 |
| JP | 5 153692 | | 6/1993 |
| JP | 6 178385 | | 6/1994 |
| JP | 6 225383 | | 8/1994 |
| JP | 9 284884 | | 10/1997 |
| JP | 10-316828 | A | 12/1998 |
| JP | 10-316841 | | 12/1998 |
| JP | 2003 319488 | | 11/2003 |
| JP | 2004 15194 | | 1/2004 |
| JP | 2004 238469 | | 8/2004 |
| JP | 2004 274661 | | 9/2004 |
| JP | 2006 233161 | | 9/2006 |
| WO | WO 2007043837 | A1 * | 4/2007 |
| WO | WO 2008068897 | A1 * | 6/2008 |

OTHER PUBLICATIONS

English translation of JP S62202699, 1987.*
Machine translation of JP H06225383, 1994.*
Notice of Grounds of Rejection issued Aug. 21, 2012 in Japanese Patent Application No. 2011-500654 (with English translation).
International Search Report Issued Mar. 30, 2010 in PCT/JP10/052500 filed Feb. 19, 2010.
Combined Office Action and Search Report issued Jul. 25, 2013 in Chinese Patent Application No. 201080008768.3 (with English-language translation).
Office Action issued Apr. 23, 2013, in German Patent Application No. 11 2010 000 679.2 with English translation.

* cited by examiner

*Primary Examiner* — Wenwen Cai
(74) *Attorney, Agent, or Firm* — Oblon, McClelland, Maier & Neudtadt, L.L.P.

(57) ABSTRACT

A speaker diaphragm contains a material obtained by adding a cycloolefin polymer resin to a carbon fiber-reinforced liquid crystal polymer. The speaker diaphragm having high sound velocity, a speaker, and a production method of the speaker diaphragm can thereby be obtained.

7 Claims, 4 Drawing Sheets

SPEAKER DIAPHRAGM, SPEAKER, AND PRODUCTION METHOD OF SPEAKER DIAPHRAGM

TECHNICAL FIELD

The present invention relates to a speaker diaphragm, a speaker, and a production method of a speaker diaphragm

BACKGROUND ART

As a conventional speaker diaphragm, a diaphragm with paper used as a material is common. This is because paper is low in apparent density and has moderate rigidity and internal loss, so that the sound velocity of the diaphragm is relatively high (sound velocity=$(E/p)^{1/2}$, E: elastic modulus, p: density). The higher the sound velocity, the follow-up capability of vibrations of the diaphragm in response to an electric signal is improved. Sound distortion is thereby reduced. However, in the case of applying paper to a speaker diaphragm, process steps such as papermaking are complicated, and the stability of quality degrades, raising problems in moisture resistance and water resistance.

Moreover, metallic materials such as titanium and aluminum are also used as a material of a diaphragm for the sake of rigidity greater than that of paper, however, they have a drawback of having small internal loss. This raises problems in frequency characteristics in that a sharp peak occurs in a high frequency range and distortion increases. Therefore, their uses are limited.

In order to improve workability, moisture resistance and water resistance, plastic materials such as a polypropylene resin are increasingly used as the material of a diaphragm, but they are disadvantageous in leading to insufficient sound velocity. Therefore, application of engineering plastics having great rigidity has been attempted.

For example, in Japanese Patent Laying-Open No. 6-225383 (Patent Literature 1), a material obtained by blending a cycloolefin polymer resin with a 4-methylpentene resin, and further adding mica and graphite thereto is applied to a diaphragm. For example, in Japanese Patent Laying-Open No. 2-276399 (Patent Literature 2), a diaphragm is molded from a material obtained by blending a liquid crystal polymer with a poly (4-methylpentene-1) resin, and compounding carbon fibers therewith.

CITATION LIST

Patent Literature

PTL 1: Japanese Patent Laying-Open No. 6-225383
PTL 2: Japanese Patent Laying-Open No. 2-276399

SUMMARY OF INVENTION

Technical Problem

However, a material mainly composed of a cycloolefin polymer resin leads to insufficient sound velocity of a speaker diaphragm. Although a material obtained by blending a liquid crystal polymer with a 4-methylpentene resin and compounding carbon fibers therewith has significantly high sound velocity, further improvement in sound velocity is necessary for further improving frequency characteristics. A sound velocity more than or equal to 4000 (m/s) is desirable.

The present invention was made in view of the above-described problem, and has an object to provide a speaker diaphragm having high sound velocity, a speaker, and a production method of a speaker diaphragm.

Solution to Problem

A speaker diaphragm of the present invention contains a material obtained by adding a cycloolefin polymer resin to a carbon fiber-reinforced liquid crystal polymer.

Advantageous Effects of Invention

Since the speaker diaphragm of the present invention contains a material obtained by adding a cycloolefin polymer resin to a carbon fiber-reinforced liquid crystal polymer. the rigidity increases, allowing the sound velocity of the speaker diaphragm to be increased.

DESCRIPTION OF EMBODIMENTS

Hereinafter, one embodiment of the present invention will be described based on the drawings.

Figure 1:
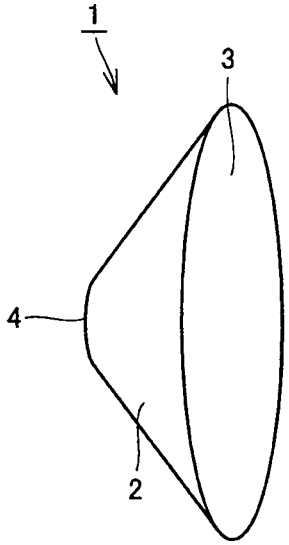
FIG. 1 is a schematic perspective view of a speaker diaphragm in one embodiment of the present invention.

The structure of a speaker diaphragm of one embodiment of the present invention will be described first. With reference to FIG. 1, a speaker diaphragm 1 of one embodiment of the present invention mainly includes a side section 2, a front section 3, and a bottom section 4.

A material of the speaker diaphragm of one embodiment of the present invention will now be described.

Speaker diaphragm 1 contains a material obtained by adding a cycloolefin polymer resin to a carbon fiber-reinforced liquid crystal polymer. For this material, as an example of the compounding ratio between the carbon fiber-reinforced liquid crystal polymer and the cycloolefin polymer resin, a material having a compounding ratio of 90% carbon fiber-reinforced liquid crystal polymer and 10% cycloolefin polymer resin by mass is used. As another example, a material having a compounding ratio of 60% carbon fiber-reinforced liquid crystal polymer and 40% cycloolefin polymer resin by mass is used. As still another example, a material having a compounding ratio of 57% carbon fiber-reinforced liquid crystal polymer, 38% cycloolefin polymer resin, and 5% carbon nanotubes by mass is used.

From the foregoing, for example, 90% to 57% carbon fiber-reinforced liquid crystal polymer by mass is preferably contained as a material of speaker diaphragm 1. For example, 10% to 38% cycloolefin polymer resin by mass is preferably contained. As another element, for example, less than or equal to 5% carbon nanotubes by mass may be contained.

The carbon fiber-reinforced liquid crystal polymer is made of a material represented by Chemical Formula (1) below, for example. The carbon fiber-reinforced liquid crystal polymer may be made of a material represented by Chemical Formula (2) or (3) below.

The structure of a speaker having the speaker diaphragm of one embodiment of the present invention will now be described.

Figure 2:
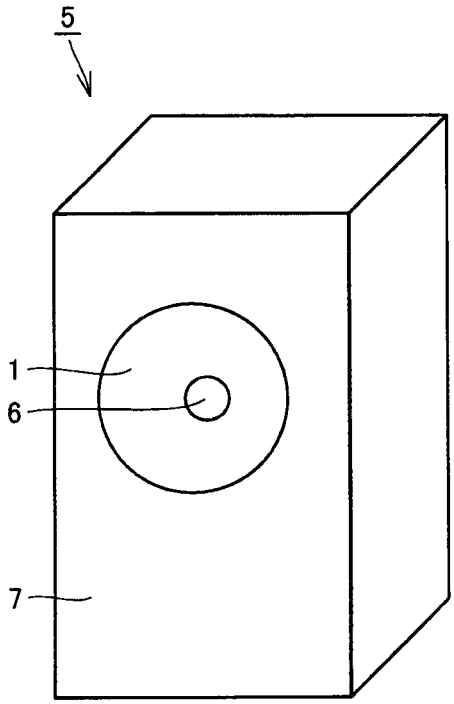
FIG. 2 is a schematic perspective view of a speaker in one embodiment of the present invention.

With reference to FIG. 2, a speaker 5 mainly includes speaker diaphragm 1, a speaker unit equipped with a cap 6, a voice coil, a frame, and the like, and a speaker box (supporting member) 7. The speaker unit is attached to speaker box 7 such that front section 3 of speaker diaphragm 1 is arranged at the front face of speaker box 7 and side section 2 and bottom section 4 are arranged inside speaker box 7. Cap 6 is attached to the central part of front section 3 of speaker diaphragm 1 for protection against dust, and the like.

A production method of the speaker diaphragm of one embodiment of the present invention will now be described.

[Chemical Formula 1]

(1)

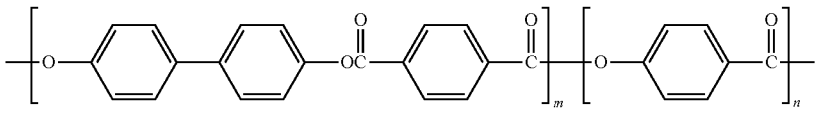

[Chemical Formula 2]

(2)

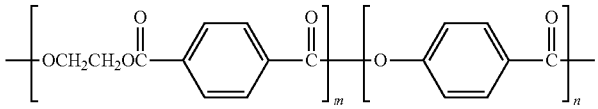

[Chemical Formula 3]

(3)

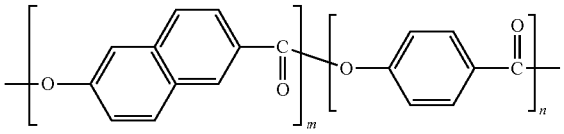

The cycloolefin polymer resin is made of a material represented by Chemical Formula (4) below, for example. The cycloolefin polymer resin may be made of a material represented by Chemical Formula (5) or (6) below.

[Chemical Formula 4]

(4)

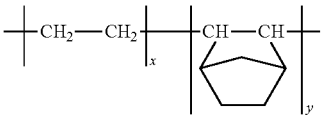

[Chemical Formula 5]

(5)

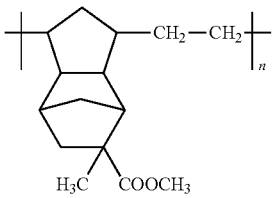

[Chemical Formula 6]

(6)

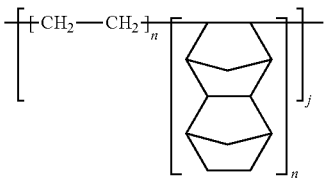

A material obtained by adding 10% cycloolefin polymer resin to 90% carbon fiber-reinforced liquid crystal polymer by mass is produced. A material obtained by adding 40% cycloolefin polymer resin to 60% carbon fiber-reinforced liquid crystal polymer by mass is also produced. A material obtained by adding 38% cycloolefin polymer resin and 5% carbon nanotubes to 57% carbon fiber-reinforced liquid crystal polymer by mass is also produced. The above-described respective materials are kneaded to produce each pellet.

Figure 4:
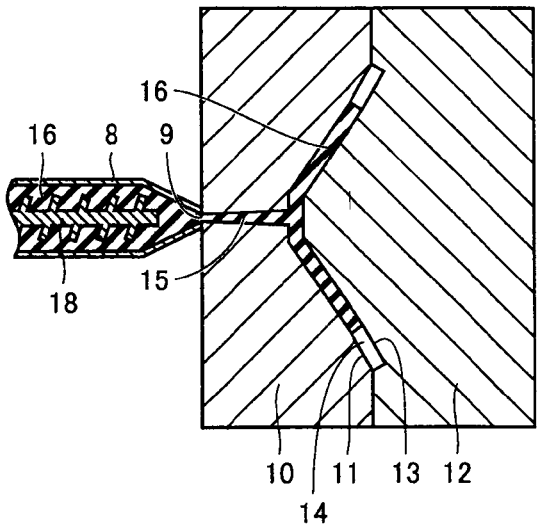
FIG. 4 is a schematic cross sectional view showing a manner in which the speaker diaphragm molded product in one embodiment of the present invention is injection molded.

With reference to FIG. 4, each pellet described above is molten to obtain a molten resin 16. An injection molder cylinder 8 is filled with this molten resin 16. Molten resin 16 is moved to an opening 9 by a screw 18 provided for injection molder cylinder 8. Molten resin 16 is injected into a fixed mold 10 through opening 9.

Figure 3:
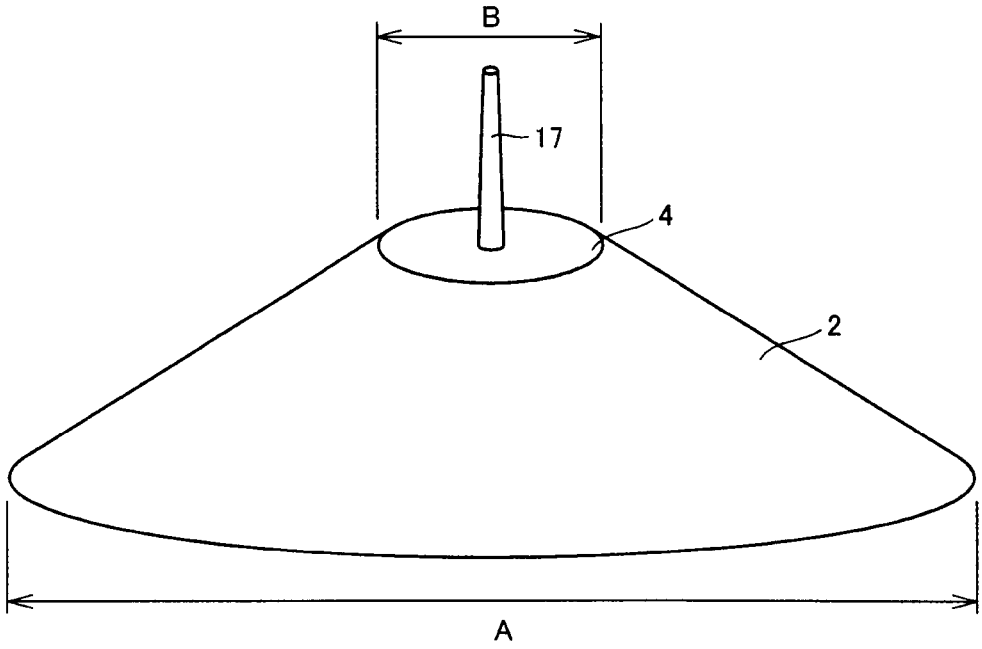
FIG. 3 is a schematic perspective view of a speaker diaphragm molded product in one embodiment of the present invention.

A mold with which speaker diaphragm 1 is injection molded has fixed mold 10 and a movable mold 12. Fixed mold 10 has a central part 11 formed in a recessed shape. Fixed mold 10 also has a cavity injection area 15 formed in a cylindrical shape. Cavity injection area 15 is in communication with opening 9 of injection molder cylinder 8. Cavity injection area 15 presents a tapered shape whose diameter increases toward central part 11. Movable mold 12 has a central part 13 formed in a protruding shape. A clearance between the recessed shape of central part 11 of fixed mold 10 and the protruding shape of central part 13 of movable mold 12 constitutes a cavity molding area 14. The shape of an inner space between the molds when these fixed mold 10 and movable mold 12 are fitted presents the shape of a speaker diaphragm molded product shown in FIG. 3.

Figure 5:
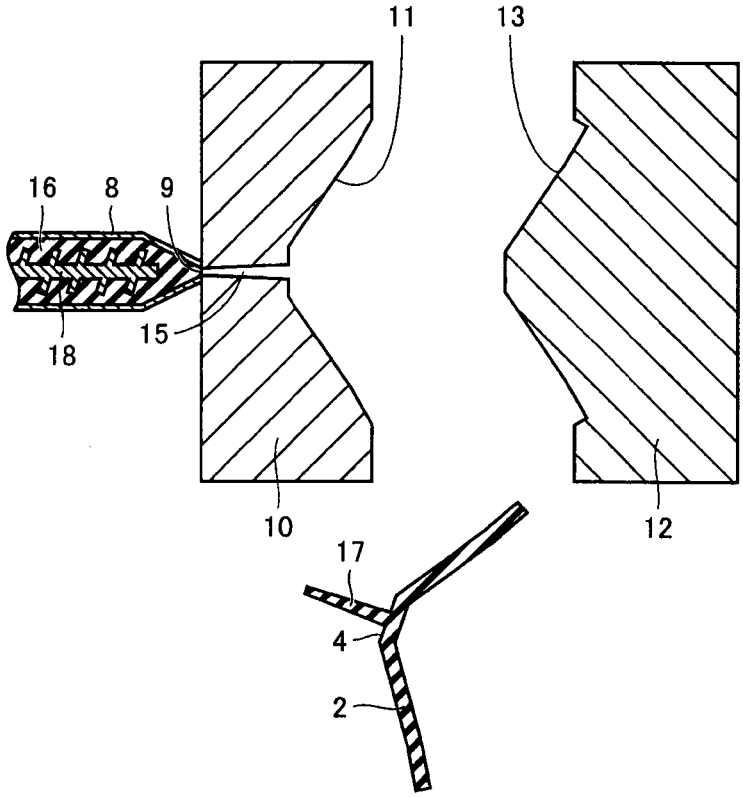
FIG. 5 is a schematic cross sectional view showing a manner in which the speaker diaphragm molded product in one embodiment of the present invention has been injection molded.

Molten resin 16 injected into fixed mold 10 through opening 9 moves to cavity molding area 14 through cavity injection area 15. With reference to FIG. 5, after cavity molding area 14 is filled with molten resin 16, processes of dwelling, cooling, and mold opening are performed to mold the speaker diaphragm molded product. Then, a projection 17 formed in cavity injection area 15 is cut away from the speaker diaphragm molded product. Thus, speaker diaphragm 1 is formed by injection molding.

Figure 6:
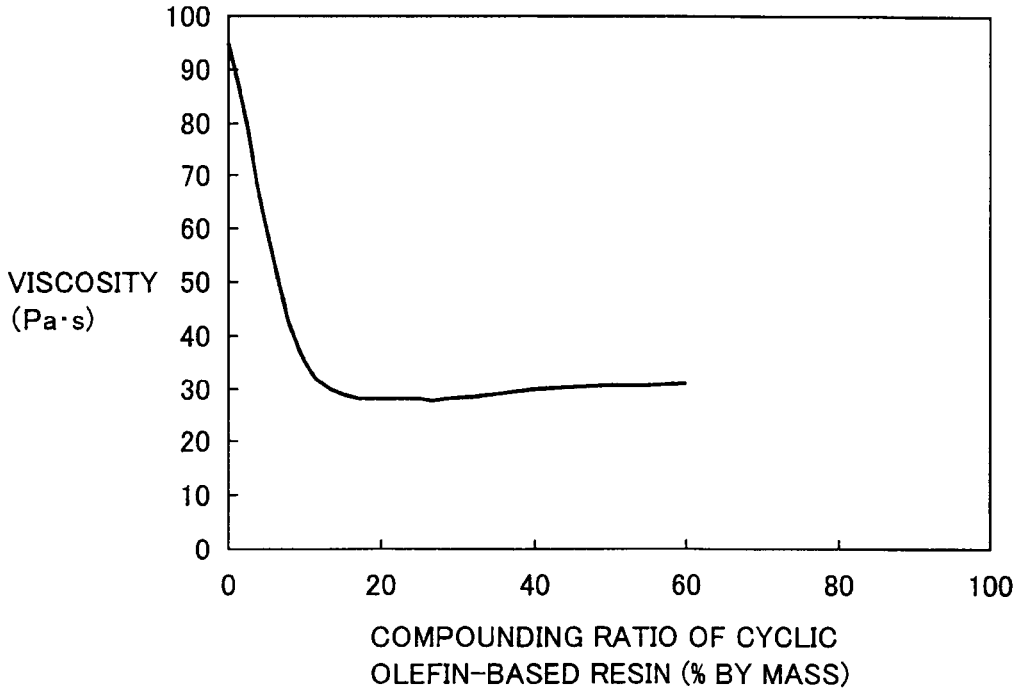
FIG. 6 shows the relation between the compounding ratio and viscosity of a carbon fiber-reinforced liquid crystal polymer and a cycloolefin polymer resin constituting the speaker diaphragm in one embodiment of the present invention.

With reference to FIG. 6, the above-described material having a compounding ratio of 10% cycloolefin polymer resin by mass has a viscosity of 35 (Pa·s). In contrast, the above-described material having a compounding ratio of 0% cycloolefin polymer resin by mass has a viscosity of 95 (Pa·s). That is, the viscosity of the above-described material decreases by adding the cycloolefin polymer resin to the carbon fiber-reinforced liquid crystal polymer. This increases the fluidity of the above-described material. Thus, molten resin 16 is likely to flow into cavity molding area 14, so that speaker diaphragm 1 having a small thickness is formed.

A production method of a speaker of one embodiment of the present invention will now be described.

With reference to FIG. 2, the speaker unit with speaker diaphragm 1 described above incorporated therein is arranged toward the front face of speaker box 7. Cap 6 is attached to the central part of speaker diaphragm 1. Thus, speaker 5 is produced. Effects of the speaker diaphragm and the speaker of one embodiment of the present invention will now be described.

Since speaker diaphragm 1 of one embodiment of the present invention contains the material obtained by adding the cycloolefin polymer resin to the carbon fiber-reinforced liquid crystal polymer, the rigidity increases, allowing the sound velocity of speaker diaphragm 1 to be increased.

Further, since speaker diaphragm 1 is formed by injection molding, the carbon fiber-reinforced liquid crystal polymer is cooled and solidified while carbon fibers and liquid polymers are oriented during injection molding. The rigidity thus increases, allowing the sound velocity of speaker diaphragm 1 to be increased.

Furthermore, by blending the carbon fiber-reinforced liquid crystal polymer with the cycloolefin polymer resin, the viscosity of the material obtained by adding the cycloolefin polymer resin to the carbon fiber-reinforced liquid crystal polymer decreases. Since the fluidity of this material is thereby improved, speaker diaphragm 1 can be molded thin. Speaker diaphragm 1 can thereby be reduced in weight. In addition, the moderate internal loss of the carbon fiber-reinforced liquid crystal polymer itself is not lost.

Since speaker 5 of one embodiment of the present invention includes speaker diaphragm 1 described above, effects of speaker diaphragm 1 described above can be exerted.

Since a material having a high compounding ratio of the cycloolefin polymer resin is low in viscosity and high in fluidity, speaker diaphragm 1 can be molded thin more easily.

In the case of a material with carbon nanotubes added thereto, the carbon nanotubes are entangled with carbon fibers of the carbon fiber-reinforced liquid crystal polymer, so that the rigidity increases. The acoustic characteristics of speaker 5 can thereby be improved. That is, with reference to FIG. 7, the reproduction band of speaker 5 can be extended toward higher frequencies by the addition of carbon nanotubes.

Hereinafter, examples of the present invention will be described in detail.

EXAMPLES

Example 1

Example 1 of the present invention will be described.

With a twin screw extruder, 90% carbon fiber-reinforced liquid crystal polymer (VECTRA B230 made of polyplastics) and 10% cycloolefin polymer resin (TOPAS 5013 made of polyplastics) by mass were kneaded sufficiently at an extrusion temperature of 290° C. to make pellets.

The carbon fiber-reinforced liquid crystal polymer (VECTRA B230 made of polyplastics) was a material represented by Chemical Formula (1) above. The cycloolefin polymer resin (TOPAS 5013 made of polyplastics) was a material represented by Chemical Formula (4) above.

This pellet was then dried at 120° C. for 5 hours. Thereafter, injection molding was performed with a mold having carved therein the shape of the speaker diaphragm molded product (FIG. 3) having an outer diameter (A in FIG. 3) of 136 mm, an inner diameter (B in FIG. 3) of 35 mm, and a thickness of 0.3 mm, using an injection molder having a mold clamping force of 100 tons. A speaker diaphragm was molded at a resin temperature of 320° C., at an injection pressure of 200 MPa, for an injection time of 0.05 second, at a mold temperature of 110° C., and for a cooling time of 20 seconds.

The elastic modulus was measured in a tension mode by a dynamic viscoelastometer (DMS6100 available from Seiko Instruments, Inc.) using a specimen cut out from the molded product. The measured elastic modulus was divided by the density measured by a densimeter to calculate a specific elastic modulus. The sound velocity was obtained from the square root of the specific elastic modulus.

The loss coefficient was calculated from a half value width of the lowest resonance frequency using loss coefficient measuring equipment (Dual Channel Signal Analyzer, Type2034 available from Bruel&Kjaer). Density, elastic modulus, sound velocity, and loss coefficient are shown in Table 1. The sound velocity had a high value of about 5122 (m/s).

TABLE 1

| | Density ($g/cm^3$) | Elastic modulus (GPa) | Sound velocity (m/s) | Loss coefficient |
|---|---|---|---|---|
| Example 1 | 1.41 | 37.0 | 5122 | 0.041 |
| Example 2 | 1.31 | 26.0 | 4455 | 0.037 |
| Example 3 | 1.33 | 28.8 | 4653 | 0.035 |
| Comparative Example 1 | 1.08 | 5.8 | 2317 | 0.36 |
| Comparative Example 2 | 1.25 | 10.6 | 3633 | 0.50 |

Comparative Example 1 relative to the present example will now be described.

In Comparative Example 1, pellets were made of 50% cycloolefin polymer resin, 25% poly 4-methylpentene, 15% mica, and 10% scaly graphite by mass. The remaining conditions under which the test was conducted were similar to those in Example 1. Density, elastic modulus, sound velocity, and loss coefficient are shown in Table 1. The sound velocity had a value of about 2317 (m/s) which is lower than that of Example 1.

Comparative Example 2 relative to the present example will now be described.

In Comparative Example 2, pellets were made of 50% liquid crystal polymer, 20% poly 4-methylpentene-1, and 30% carbon fibers by mass. The remaining conditions under which the test was conducted were similar to those of Example 1. Density, elastic modulus, sound velocity, and loss coefficient are shown in Table 1. The sound velocity was improved as compared to that of Comparative Example 1, but had a value lower than that of Example 1.

As shown in Table 1, it was revealed that the sound velocity of Example 1 of the present invention was higher than those of Comparative Examples 1 and 2.

Example 2

Example 2 of the present invention will now be described.

With a twin screw extruder, 60% carbon fiber-reinforced liquid crystal polymer (VECTRA B230 made of polyplastics) and 40% cycloolefin polymer resin (TOPAS 5013 made of polyplastics) by mass were kneaded sufficiently at an extrusion temperature of 290° C. to make pellets. The remaining conditions under which the test was conducted were similar to those in Example 1.

Density, elastic modulus, sound velocity, and loss coefficient are shown in Table 1. The sound velocity had a favorable value of about 4455 (m/s). As shown in Table 1, it was revealed that the sound velocity of Example 2 of the present invention was higher than those of Comparative Examples 1 and 2.

Example 3

Example 3 of the present invention will now be described.

With a twin screw extruder, 57% carbon fiber-reinforced liquid crystal polymer (VECTRA B230 made of polyplastics), 38% cycloolefin polymer resin (TOPAS 5013 made of polyplastics), and 5% multilayer carbon nanotubes (fiber diameter of 40 to 90 nm, fiber length of several tens of micrometers) by mass were kneaded sufficiently at an extrusion temperature of 290° C. to make pellets. The remaining conditions under which the test was conducted were similar to those in Example 1.

Density, elastic modulus, sound velocity, and loss coefficient are shown in Table 1. The sound velocity had a favorable value of about 4653 (m/s), similarly to Example 2. As shown in Table 1, it was revealed that the sound velocity of Example 3 of the present invention was higher than those of Comparative Examples 1 and 2.

Figure 7:
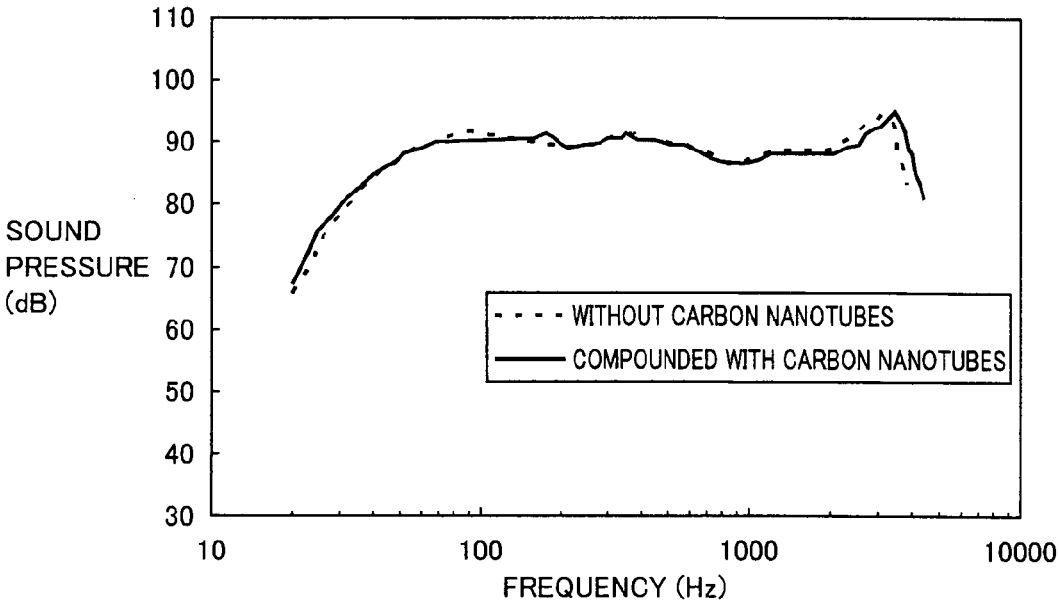
FIG. 7 shows the relation between the frequency and sound pressure of a speaker in one embodiment of the present invention in which the diaphragm has been compounded with carbon nanotubes and a speaker without carbon nanotubes compounded therewith.

Moreover, speaker diaphragm 1 was cut out from a molded product, and the frequency characteristics of speaker 5 with speaker diaphragm 1 incorporated therein was measured. The results are shown in FIG. 7. It was revealed that the reproduction band extended toward higher frequencies by the addition of carbon nanotubes.

It is noted that it was confirmed that similar effects were also achieved in any combination of one of Chemical Formulas (1), (2) and (3) with one of Chemical Formulas (4), (5) and (6).

It should be considered that the embodiments and examples disclosed herein are illustrative and non-restrictive in any respect. The scope of the present invention is defined by the scope of claims rather than the description above, and is intended to include any modifications within the meaning and scope equivalent to the terms of the claims.

INDUSTRIAL APPLICABILITY

The present invention may be applied advantageously in particular to a speaker diaphragm, a speaker, and a production method of the speaker diaphragm.

REFERENCE SIGNS LIST

1 speaker diaphragm; 2 side section; 3 front section; 4 bottom section; 5 speaker, 6 cap, 7 speaker box; 8 injection molder cylinder; 9 opening, 10 fixed mold; 11 central part; 12 movable mold; 13 central part; 14 cavity molding area; 15 cavity injection area; 16 molten resin; 17 projection; 18 screw

The invention claimed is:

1. A speaker diaphragm, comprising a material comprising:

more than or equal to 57% and less than or equal to 90% by mass of a carbon fiber-reinforced liquid crystal polymer;

a carbon nanotube; and more than or equal to 10% and less than or equal to 38% by mass of a cycloolefin polymer resin.

2. The speaker diaphragm of claim 1, wherein the material comprises 5% by mass of the carbon nanotube.

3. The speaker diaphragm of claim 1, wherein the carbon fiber-reinforced liquid crystal polymer comprises at least one selected from the group consisting of (1) an aromatic copolyester of 4,4'-dihydroxybiphenylterephthalate and 4-hydroxybenzoic acid, (2) an aromatic copolyester of ethylene terephthalate and 4-hydroxybenzoic acid, and (3) an aromatic copolyester of 6-hydroxy-2-naphthoic acid and 4-hydroxybenzoic acid.

4. The speaker diaphragm of claim 1, wherein the cycloolefm polymer resin comprises at least one selected from the group consisting of (4) a copolymer of ethylene and norbornene, (5) poly((octahydro-5,5-(methoxycarbonyl-methyl)-4,7-methano-1H-indene-1,3-diyl)-1,2-ethanediyl), and (6) a copolymer of ethylene and tetracyclododecene.

5. The speaker diaphragm of claim 1, wherein the cycloolefin polymer resin is at least one selected from the group consisting of (4) a copolymer of ethylene and norbornene and (6) a copolymer of ethylene and tetracyclododecene.

6. The speaker diaphragm of claim 1, wherein the only polymers present in the material are the liquid crystal polymer and the cycloolefin polymer resin.

7. A speaker, comprising the speaker diaphragm of claim 1.

* * * * *